US005250014A

United States Patent [19]

Chang

[11] Patent Number: 5,250,014

[45] Date of Patent: Oct. 5, 1993

[54] WEIGHT ADJUSTABLE DUMBBELL

[76] Inventor: Ching-Yi Chang, 64, Lane 110, Sec. 1, Chang Mei Ro, Changhua, Taiwan

[21] Appl. No.: 957,229

[22] Filed: Oct. 6, 1992

[51] Int. Cl.[5] ..... A63B 13/00

[52] U.S. Cl. ..... 482/106; 482/108

[58] Field of Search ..... 428/132, 148, 108, 106, 428/93, 92, 107, 109; 273/424, 58 B

[56] References Cited

U.S. PATENT DOCUMENTS

| | | | |
|---|---|---|---|
| 675,314 | 5/1901 | Abenheim | 482/108 |
| 1,326,013 | 12/1919 | Ayd | 482/108 |
| 1,438,804 | 12/1922 | Albizu | 482/108 |
| 3,311,374 | 3/1967 | Wittenberg et al. | 482/106 |
| 4,361,324 | 11/1982 | Baroi | 482/132 |

FOREIGN PATENT DOCUMENTS

| | | | |
|---|---|---|---|
| 598554 | 10/1959 | Italy | 482/108 |

*Primary Examiner*—Richard J. Apley
*Assistant Examiner*—Jerome Donnelly
*Attorney, Agent, or Firm*—James P. Hanrath; Thomas R. Vigil

[57] ABSTRACT

A weight adjustable dumbbell including two spherical shells joined by a short bar, each spherical shell comprising two equal parts connected by a respective lock bolt, with circular cushion plates retained therebetween to hold any of a variety of counter weights, wherein the circular cushion plates have a center hole, through which the respective lock screw bolt is inserted, a plurality of projections spaced around a peripheral edge thereof at equal intervals extending out of the respective spherical shell for protecting the spherical shells against impact, and two annular grooves on two opposite sides around the border into which the peripheral edge of either semi-spherical shell of the respective spherical shell fits respectively.

2 Claims, 3 Drawing Sheets

WEIGHT ADJUSTABLE DUMBBELL

BACKGROUND OF THE INVENTION

1. Field of the Invention

The present invention relates to dumbbells and relates more particularly to a dumbbell which can be conveniently adjusted to change its weight.

2. Description of Prior Art

Conventionally, a dumbbell is simply comprised of a short bar of wood or iron with heavy ends, used in exercising the arms. This structure of dumbbell has a fixed total weight once it was made. Because the total weight is not adjustable, different dumbbells shall be used for different amounts of exercise. In order to solve this problem, there is disclosed a weight adjustable dumbbell, as shown in FIG. 1, which is generally comprised of a short bar having a plurality of pin holes symmetrically spaced on two opposite ends thereof for releasably fastening different pairs of round weights by lock pins. One disadvantage of this weight adjustable dumbbell is that the round weights may oscillate on the two opposite ends of the short bar as it is lifted or swung about in the hand for muscular exercise, causing a balancing problem. Another disadvantage of this weight adjustable dumbbell is that the lock pins may disconnect from the short bar or be broken easily causing the round weights to suddenly displace from respective positions or drop from the short bar, and therefore an exercising accident may happen easily.

SUMMARY OF THE INVENTION

The present invention eliminates the aforesaid circumstances. It is therefore an object of the present invention to provide a dumbbell which can be conveniently adjusted to change its weight according to different requirements without changing the configuration. It is another object of the present invention to provide a dumbbell which does not move once it was placed on the ground. It is still another object of the present invention to provide a dumbbell which has means to protect itself against impact.

According to one aspect of the present invention, the dumbbell is generally comprised of two spherical shells joined by a short bar, wherein each spherical shell comprises two equal semi-spherical shells connected together by a respective lock screw bolt with a circular cushion plate retained therebetween to hold down a respective counter weight. According to another aspect of the present invention, the circular cushion plate is made from a resilient plastic material which can be squeezed to deform so as to hold down the respective counter weight in place. According to still another aspect of the present invention, the circular cushion plate has a plurality of projections spaced around a peripheral edge thereof at equal intervals extended out of the respective spherical shell for positioning the respective spherical shell on the ground and protecting it against impact, and two annular grooves on two opposite sides around the border into which the peripheral edge of either semi-spherical shell of the respective spherical shell fits respectively.

BRIEF DESCRIPTION OF THE DRAWINGS

The foregoing and other objects, features and advantages of the present invention will be best understood from the following description, the appended claims and the accompanying drawings in which:

DETAILED DESCRIPTION OF THE PREFERRED EMBODIMENT

Figure 1:
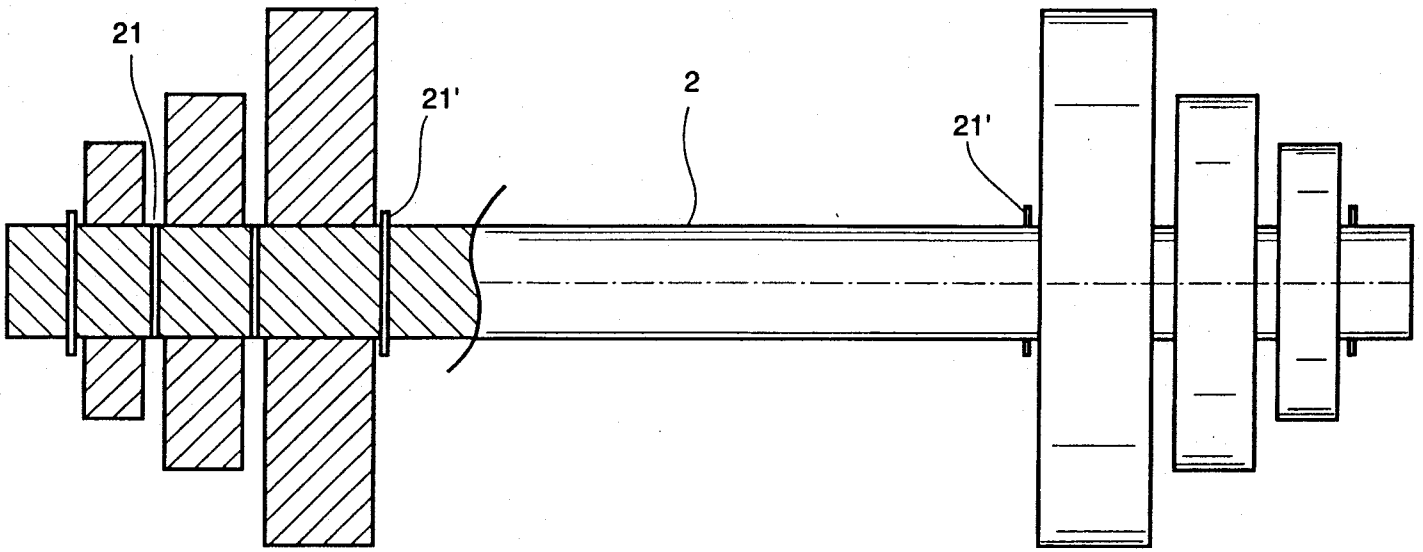
PRIOR ART FIG. 1
FIG. 1 is a sectional plan view of a weight adjustable dumbbell according to the prior art.
Figure 2B:
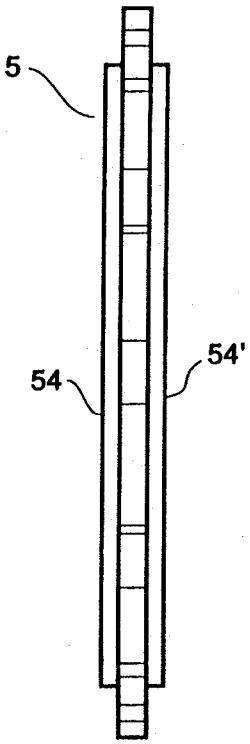
FIGS. 2A and FIGS. 2B are a front view and a side view of a circular cushion plate according to the present invention.
Figure 2A:
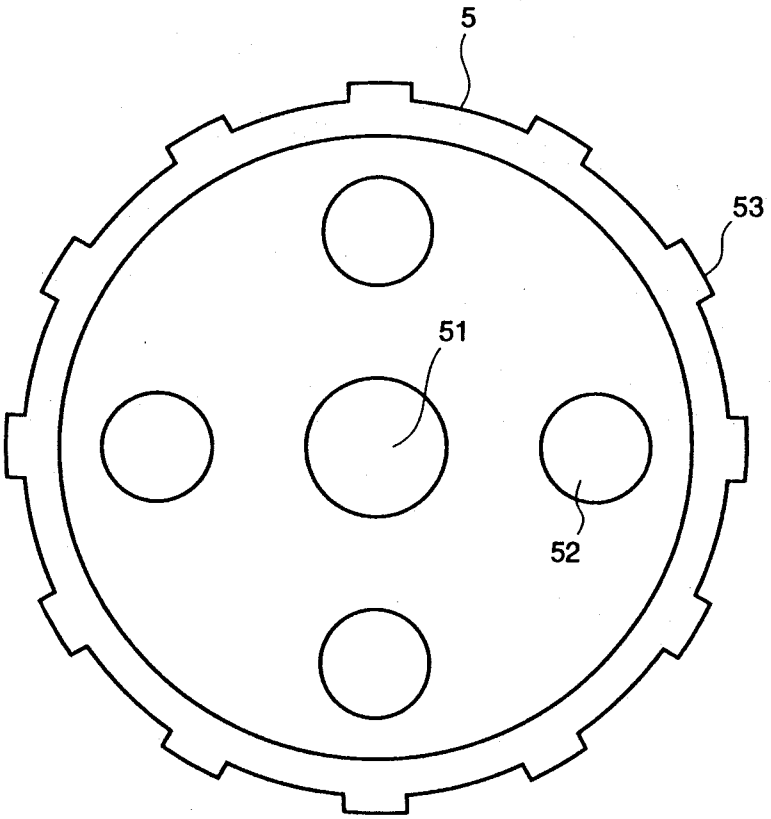
Figure 3:
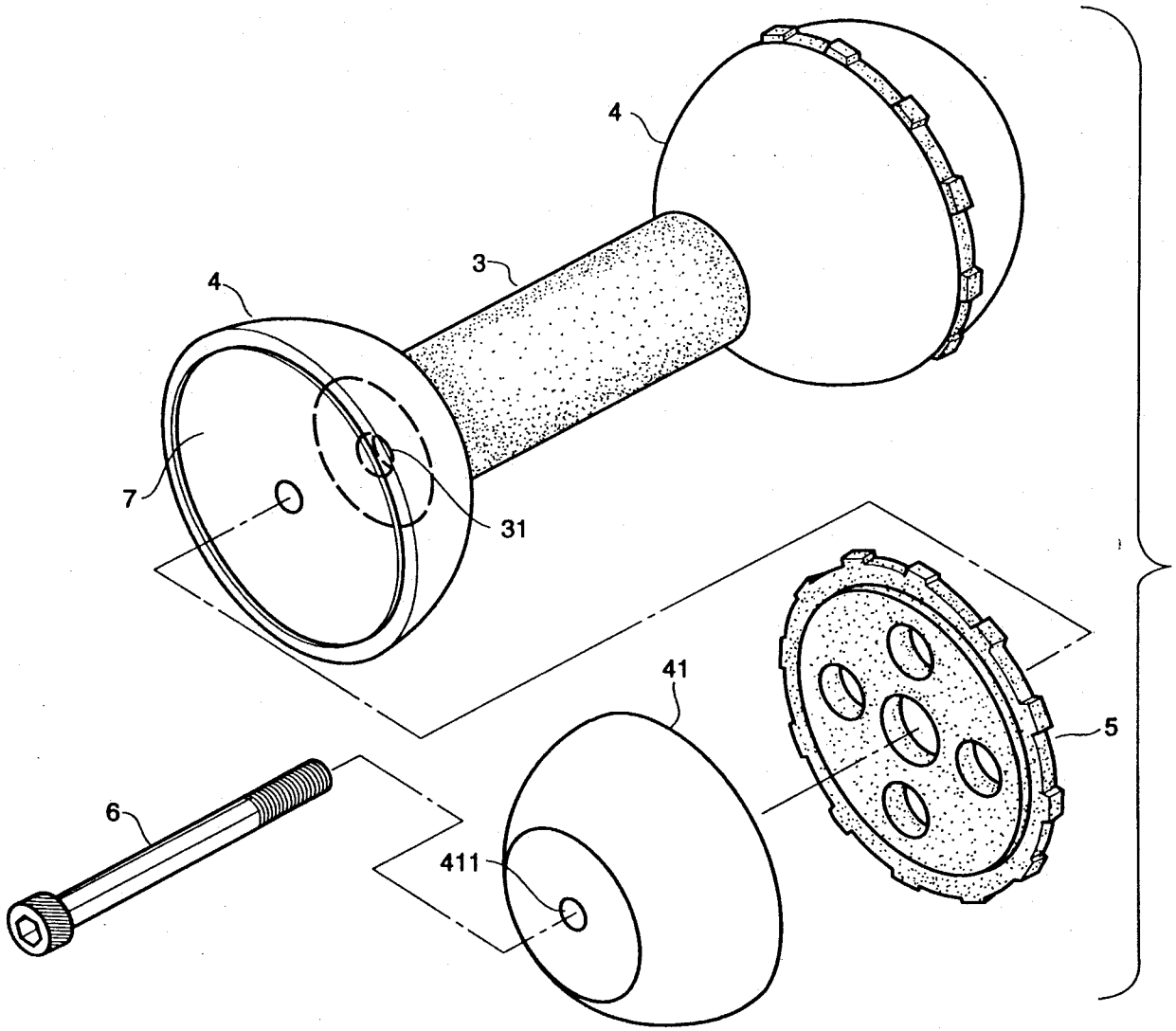
FIG. 3 is an exploded view of a dumbbell embodying the present invention.

Referring to FIGS. 2A, 2B and 3, a dumbbell as constructed in accordance with the present invention is generally comprised of a grip 3, two spherical shells 4, two circular cushion plates 5, two lock screw bolts 6, and pairs of spherical counter weights 7. The grip 3 is made from a short round bar having two bolt holes 31 on two opposite ends in line with the central axis thereof. The spherical shells 4 are identical. Each spherical shell 4 is consisted of two equal semi-spherical shells 41, of which each has a countersunk hole 411 through the respective center and aligned with each other, wherein one semi-spherical shell 41 of either spherical shell 4 is directly fastened to the grip 3 at either end with the other semi-spherical shell 41 detachably and respectively connected thereto by either lock screw bolt 6. As two equal semi-spherical shells 41 are connected together and formed into one spherical shell 4, one circular cushion plate 5 is firmly retained therebetween. A circular cushion plate 5 according to the present invention is made from a resilient plastic material having a plurality of through holes 52 around a center hole 51 thereof and a plurality of projections 53 spaced around the peripheral edge thereof at equal intervals and two annular grooves 54, 54' on two opposite sides around the border. The arrangement of the through holes 52 on the circular cushion plate 5 is to reduce the consumption of the material. The pairs of spherical counter weights 7 are equal in size but different in weight. Each spherical counter weight 7 comprises two equal semi-spherical parts, which may respectively fit into either semi-spherical shell 41. By inserting one semi-spherical part or both of the two equal spherical parts of either spherical counter weight in either spherical shell 4, the total weight of the dumbbell is relatively changed. The aforesaid parts can be conveniently assembled into a dumbbell by threading each lock screw bolt 6 through the center holes 411 on the two semi-spherical shells 4 at either end of the grip 3, the center hole 51 on the respective circular cushion plate 5 and the center hole 71 on the respective spherical counter weight 7 into the respective bolt hole 31 on the grip 3. As the two semi-spherical shells 41 of either spherical shell 4 are connected together with the respective circular cushion plate 5 retained therebetween, the peripheral edge of each semi-spherical shell 41 fits into either annular groove 54 or 54' on either side of the respective circular cushion plate 5 to firmly retain the respective spherical counter weight 7 (or either semi-spherical part of the respective spherical counter weight 7) in place. When assembled, the projections 53 of the two circular cushion plates 5 project out of the spherical shells 4 respectively to prohibit the dumbbell from running on the ground and protect the spherical shells 4 against impact.

What is claimed is:

1. A weight adjustable dumbbell including two spherical shells joined by a short bar, each spherical shell comprising two equal semi-spherical shells connected together by a respective lock screw bolt to hold a respective counter weight and a circular cushion plate is received and connected between the two equal semi-spherical shells of either spherical shell to hold the respective counter weight, the circular cushion plate having a center hole through which the respective lock screw bolt inserts, a plurality of projections spaced around a peripheral edge thereof at equal interval respectively extended out of the respective spherical shell for positioning the respective spherical shell on the ground and protecting it against impact, and two annular grooves on two opposite sides around the border into which the peripheral edge of either semi-spherical shell of the respective spherical shell fits respectively.

2. The dumbbell according to claim 1 wherein the circular cushion plate has a plurality of holes around the center hole thereof.

* * * * *